US006527128B1

(12) United States Patent
Samaria

(10) Patent No.: US 6,527,128 B1
(45) Date of Patent: Mar. 4, 2003

(54) PERPENDICULAR DISPLAY RACK FOR PEG RACK SUPPORT MEMBERS

(76) Inventor: Joseph J. Samaria, 4360 Ponca Ave., North Hollywood, CA (US) 91602

( * ) Notice: Subject to any disclaimer, the term of this patent is extended or adjusted under 35 U.S.C. 154(b) by 0 days.

(21) Appl. No.: 09/584,827

(22) Filed: May 31, 2000

(51) Int. Cl.[7] ..... A47F 5/08
(52) U.S. Cl. ..... 211/106; 211/50; 211/88.01
(58) Field of Search ..... 211/106, 103, 211/50, 55, 733.6, 400, 88.01, 56, 45, 48, 49, 81.1, 133.6

(56) References Cited

U.S. PATENT DOCUMENTS

| | | | | | |
|---|---|---|---|---|---|
| 1,235,225 | A | * | 7/1917 | Miller | 211/106 |
| 2,167,375 | A | * | 7/1939 | Rubenstein | 211/106 |
| 2,289,042 | A | * | 7/1942 | Robertson | 211/48 |
| 2,698,690 | A | * | 1/1955 | Rubenstein | 211/106 |
| 2,738,075 | A | * | 3/1956 | Guignard et al. | 211/56 |
| 2,897,975 | A | * | 8/1959 | Rubenstein | 211/106 |
| 2,972,416 | A | * | 2/1961 | De Vivo | 211/50 |
| 3,115,252 | A | * | 12/1963 | Senical | 211/55 |
| 3,223,247 | A | * | 12/1965 | Bleed | 211/163 |
| 4,498,592 | A | * | 2/1985 | Colucci | 211/42 |
| 4,718,562 | A | | 1/1988 | Winkler, Jr. | 211/94.5 |
| 5,149,039 | A | * | 9/1992 | Peterson et al. | 248/300 |
| 5,184,737 | A | * | 2/1993 | Hardy | 211/55 |
| 5,573,124 | A | | 11/1996 | Frost | 211/181 |
| 5,579,927 | A | | 12/1996 | Thompson et al. | 211/59.1 |
| 5,632,387 | A | | 5/1997 | Johnson | 211/59.1 |
| 5,769,247 | A | * | 6/1998 | Merl | 211/103 |

* cited by examiner

*Primary Examiner*—Daniel P. Stodola
*Assistant Examiner*—Khoa Tran
(74) *Attorney, Agent, or Firm*—Kenneth P. Glynn, Esq.

(57) ABSTRACT

A perpendicular display rack for attachment to a vertical support to a display rack system, said vertical support having a plurality of vertical slots thereon. The rack has a main frame having portions connected to one another to form a first device capable of holding a package within the main frame, the main frame thus creating and encompassing open space in x-plane, y-plane and z-plane, and having an inserting side, the inserting side having sufficient opening to insert a package therein, and having an attachment side. There is also a vertical attachment connected to the attachment side of the main frame and with at least two insertable sections, which are alignable and insertable into the vertical slots of the vertical support. There is a secondary frame extending downwardly from the main frame, to form a second device capable of holding another package within the secondary frame.

12 Claims, 4 Drawing Sheets

PERPENDICULAR DISPLAY RACK FOR PEG RACK SUPPORT MEMBERS

BACKGROUND OF THE INVENTION

1. Field of the Invention

The present invention is a perpendicular rack for peg rack and shelf rack support. More specifically, it is a perpendicular rack which may be used in the spacial areas of uprights, supports or standards which are located between shelf or bubble pack rack walls and at their ends. In other words, traditional display shelving and rack units have three components, namely, the supports or uprights (standards) the walls or back members, and the shelves, peg hooks, etc. which are attached to the walls. The present invention racks are for attachment to the supports between the walls and extend perpendicularly from the walls and supports, so as to optimize use of air space which does not interface with space devoted to merchandise or otherwise goes unused.

2. Information Disclosure Statement

The following parts represent merely a survey of various display racks:

U.S. Pat. No. 5,632,387 to M. H. Johnson describes a peg racking device for displaying merchandise. The peg racking device includes an elongated shaft having a bracket which is attachable to a wall, and a removable sleeve which is axially moveable along the shaft. The bracket includes lands and the rear end of the sleeve includes a notch with interface surfaces, the interface surfaces being engageable with the lands to align the sleeve and prevent rotational movement between the sleeve and the shaft. Either the sleeve or the shaft may include a bend located intermediate the rear and front ends to create an interference fit between the sleeve and the shaft, the sleeve being readily axially moveable along the shaft at least until the bend is encountered so that the sleeve frictionally contacts the shaft to prevent the sleeve from sliding off of the shaft as a package is removed from the peg.

U.S. Pat. No. 5,579,927 to Jennings I. Thompson et al. describes a peg racking device which facilitates loading of new inventory on the back of the peg without removing the existing inventory from the front of the peg so that the inventory is sold on a FIFO basis. The device includes an elongated shaft, the rear end of which is attachable to a wall, and a removable sleeve which is axially moveable along the shaft. A locking mechanism is provided having first and second elements, the first element being carried by the shaft and the second element being carried by the sleeve. The first and second elements engage one another in the locked position to prevent relative axial movement of the sleeve with respect to the shaft. The device may include a handle having a cavity formed to receive the front end of the sleeve to assist in removing the sleeve from the shaft and replacing the sleeve on the shaft, reducing the risk of dropping the sleeve and/or inventory on the sleeve during the restocking process.

U.S. Pat. No. 5,573,124 to Michael J. Frost describes a display rack which improves the status of the prior art by incorporating the following functional features, namely: (1) compact profile for high density storage and display of various merchandise configurations, (2) breakdown into easily handled, stored and shipped basic pieces, (3) easily assembled construction of few pieces, and (4) attractive display of a wide variety of stored merchandise. This is achieved by the novel construction afforded by two basic lightweight wire grid framework panels held together in a T-shaped configuration adapted to receive removably mounted shelves in a variety of locations within the confines of a rectangular parallel piped defined by the framework. The shelves are basket shaped and adapted to mount explicitly for products of various heights on opposite sides of the T leg panel. The entire display rack assembly thus provides a compact cabinet which can be placed in a crowded showroom along an aisle for storing and viewing merchandise removably on the top and three sides. The framework packs stored articles within the entire volume of the cabinet for viewing from a front vertical display rack and two side racks containing vertically disposed removable basket shaped shelves disposed to accommodate merchandise of variable heights and shapes. The front panel constitutes a display rack for hanging merchandise on the outer surface of a lightweight wire rack panel of the T-shaped wire grid framework, which is capped top and bottom by metal end caps having encompassing vertically disposed sidewalls.

U.S. Pat. No. 4,718,562 to A. C. Winkler, Jr. describes a vertical display for packages. One or more mounting members are removably secured to a support structure. Each of the mounting members includes one or more arms extending from the support structure for supporting a plurality of the packages. The packages are each received in separate holders that are vertically suspended from the arms of the mounting members for display.

Notwithstanding the prior art, the present invention is neither taught nor rendered obvious thereby.

SUMMARY OF THE INVENTION

The present invention racks are uniquely positionable between usual and typical displays such as modular peg board systems supports or modular shelving systems wherein the peg boards or shelf backs are supported at their ends by stanchions, standards or vertical supports which interconnect with the peg boards or shelf backs or shelf supports. These supports have a series of in-line vertical slots and the present invention display racks nest therein at perpendicular positions to the supports to occupy the spaces between the peg board displays and/or shelves.

Thus, the present invention perpendicular display rack includes:

(a) a main frame having portions connected to one another to form a first device capable of holding a package, e.g. display card capable of holding product samples, made-up projects, photos, signage and promotional materials, within its main frame. (By "package" is meant any physically insertable and removable item for display, sale or sample purposes, including mounted goods, wrapped goods, signage, booklets, pamphlets and the like.) The main frame creates and encompasses open space in x-plane, y-plane and z-plane. It has an inserting side, having sufficient opening to insert a package therein, and having an attachment side adapted for attachment to a vertical support;

(b) vertical attachment means connected to the attachment side of-the main frame and having at least two insertable sections, each being alignable and insertable into vertical slots of the vertical support; and, (c) a secondary frame extending downwardly from the main frame, and having portions connected to one another to form a second device capable of holding another package, e.g. leaflets, coupons, entry forms, project instruction sheets, therein. The secondary frame likewise creates and encompasses space in x-plane, y-plane and z-plane, and has an inserting side with sufficient opening to insert a package therein.

In some preferred embodiments, the main frame forms a six sided rectilinear first device having a top, bottom, front, back, an aisle side and an attachment side, and the inserting side is selected from the top, the front, the back and the aisle side, but is preferably at the top. The present invention racks may be made of solid or open frame structures, and may be formed of any available material or materials, e.g. wood, plastic, metal, combinations or composites. In some preferred embodiments, the device is formed of open frame wire material selected from hollow: tubular material and solid wire material.

In preferred embodiments, there is also a securing means for securing at least one vertical attachment means to a vertical support. This cold be a clamp, a key lock, a combination lock, a bolted latch or any other known securing means. However, in some preferred embodiments, the vertical attachment of the main frame is adapted to receive a j-hook attachment means which is threaded at the straight end wherein the hook of the j-hook is nested upwardly in a slot of a vertical support below the vertical attachment of the main frame and is bolted down to prevent easy removal or accidental removal. Thus, in some embodiments, the securing means is a combination of at least one orifice located on at least one of the vertical attachments and a fastening device is adapted to pass through the orifice and securely attach to at least one vertical slot of a vertical support.

In some embodiments, the secondary frame forming a second device has at least two connections to remaining aspects of the display rack, at least one being directly to the main frame and at least one being to at least one of the two insertable sections of the main frame.

In yet other preferred embodiments, the perpendicular display rack further includes a removable cover which is attachable to the main frame. The cover is slidably attachable and removable, and has at least four sides, at least one of which is transparent. The perpendicular display rack removable cover and the main frame may include cover securing means to inhibit removal of the cover from the main frame., e.g. bolting mechanisms. The perpendicular display rack may include a slidable display card for mounting which is replaceable with each featured product or promotion.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
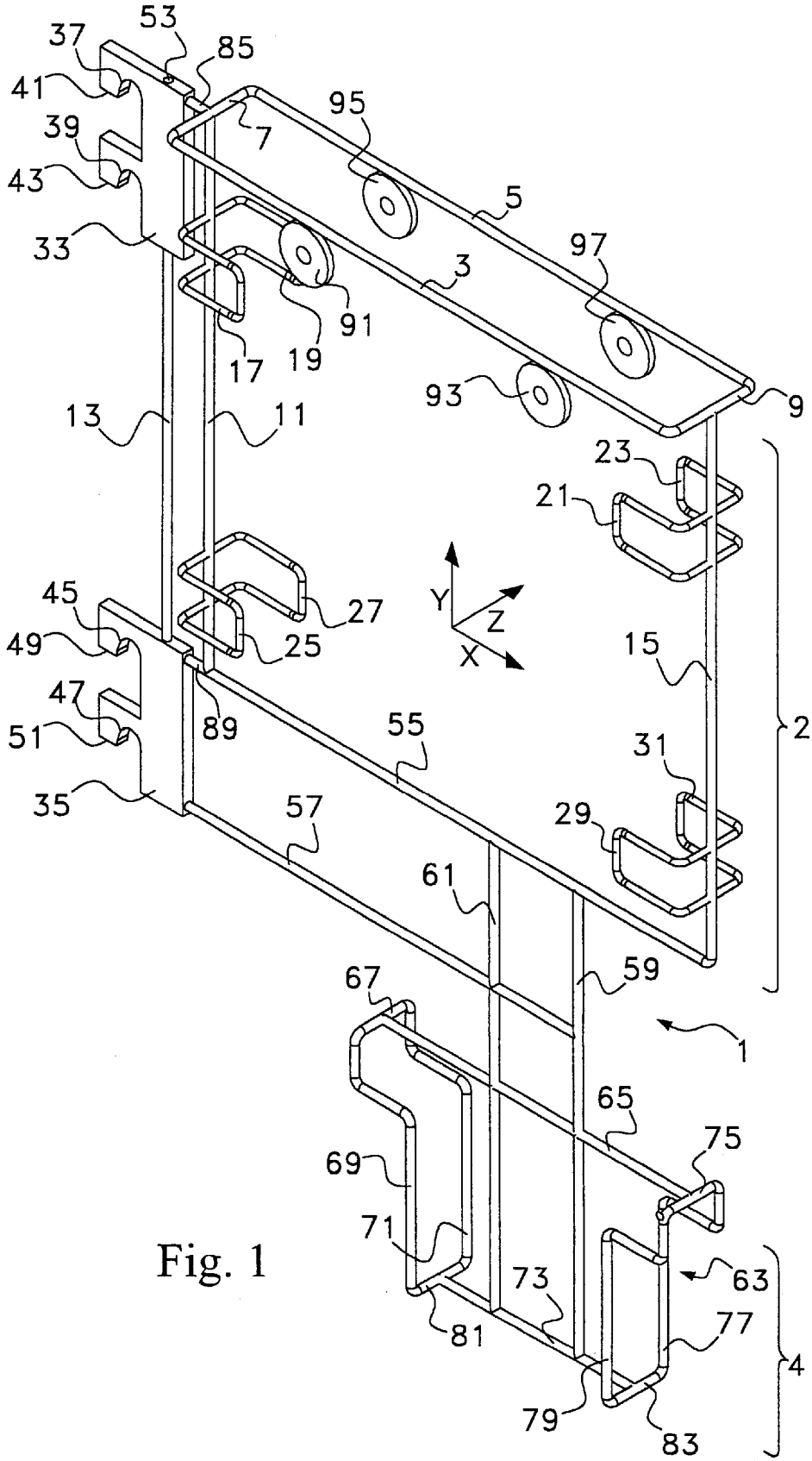
FIG. 1 shows a front perspective view of a present invention rack.

Referring now to FIG. 1, there is shown a present invention perpendicular display rack 1 for attachment to a vertical support of a display rack system. Perpendicular display rack 1 includes a main frame having various portions connected to one another. In this case, the main frame has an open top made up of four connected wire or rod sections 3, 5, 7 and 9. It also has a front which faces the viewer and this is encompassed by rods 11, 15, 55 and 3 and parts of rods 7 and 9, a back encompassed by rods 11, 15, 55 and 5 and part of rods 7 and 9. There is an attachment side framed by rods 11, 13, 85 and 89 and an aisle side formed by rod 15. Either side, or the bottom could have an open frame formation like the top formed by rods 3, 5, 7 and 9. Note that rods 11 and 15 have u-clips 17, 19, 21, 23, 25, 27, 29 and 31 which create an attachment ability for receiving a package and define a space formed in the x-plane, the y-plane and the z-plane established by main frame 2. Also, there are optional washers 91, 93, 95 and 97 formed at the top of main frame 2. These are used to bolt on a cover which is shown and described in conjunction with FIG. 7 below.

Perpendicular display rack 1 has a vertical attachment means, which in this case, are formed of two insertable sections 33 and 35 for insertion into vertical slots of a display support. These are connected via rods 13, 85 and 89 as well as rod 57, as shown. Each include insertable hold tabs, namely, tabs 41, 43, 49 and 51 to create grooves 37, 39, 45 and 47 for insertion into vertical slots and hooking thereon, as shown in FIG. 2 below.

There is a secondary frame for extending downwardly from main frame 2 via rods 59 and 61 which are cross connected to rod 57 and hence to insertable section 35. Secondary frame 4 has a top formed by rods 67 and 75 and a dividing, connecting rod 65, a front framed by rods 69 and 79, a back formed by rods 71 and 77 and a bottom formed by rods 81 and 83 with connecting dividing rod 73. Secondary frame 4 is divided into two parts by rods 65 and 73 so that a package, e.g. leaflet, coupons, entry forms, project instruction sheets, may be placed in front and a second package may be placed in back.

Figure 2:
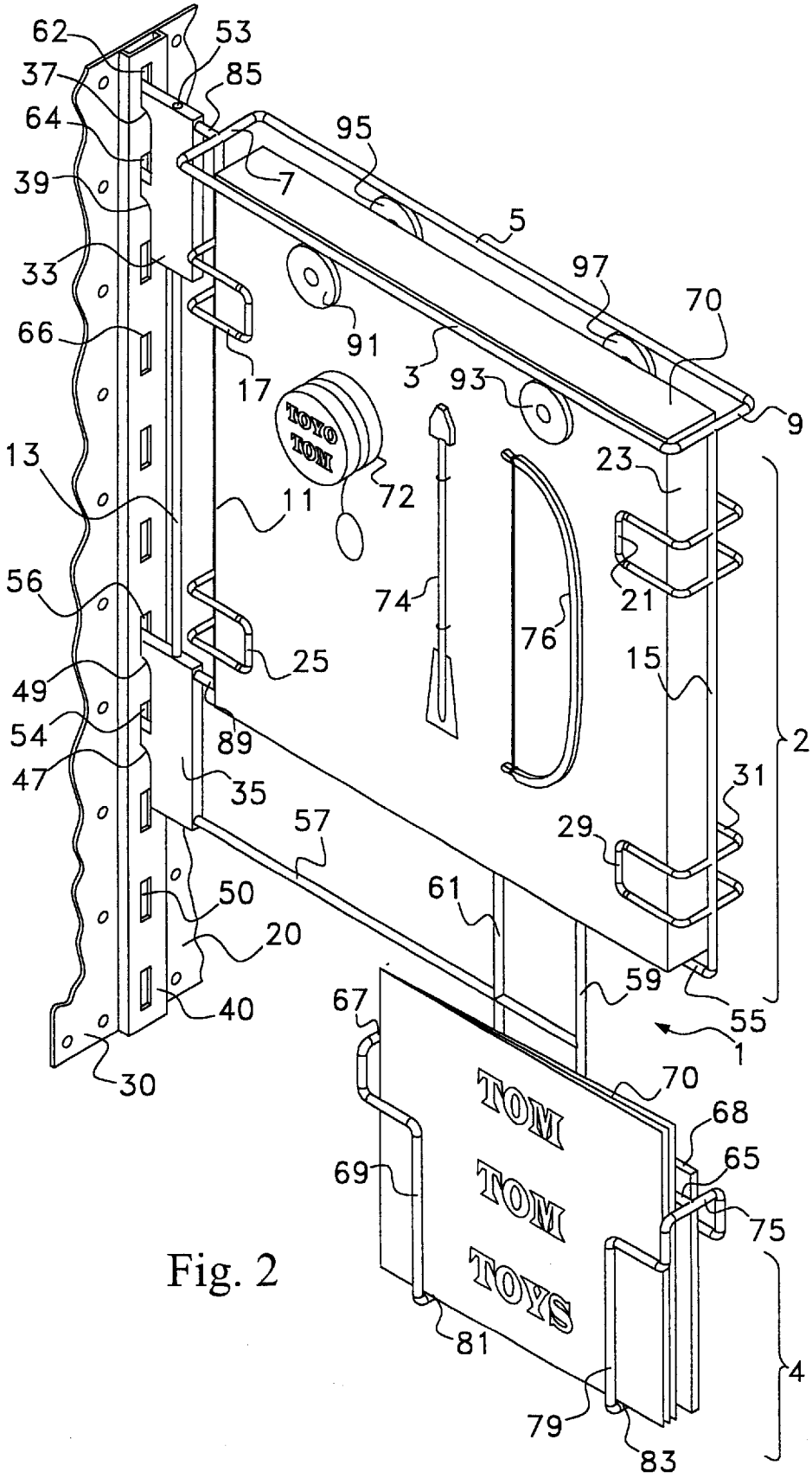
FIG. 2 shows the FIG. 1 rack mounted on a peg board support member with slidable mounting display card.

Referring to FIG. 2, the perpendicular display rack 1 of FIG. 1 is shown and identical parts are identically numbered except that, in this Figure, additional aspects are included. Thus, main frame 2 and secondary frame 4 contain packages and the entire device is attached to a vertical support. Thus, main frame 2 contains a display board 70 inserted therein with toy items, product samples, made-up projects, photos, signage, or promotional material, 72, 74 and 76.

In this Figure, vertical support rack 40 contains vertical slots such as vertical slot So and has to its left and right a peg board rack display with peg board support walls 20 and 30. Note that insertable sections 33 and 35 are inserted into slots 62 and 64, and 54 and 56, respectively, perpendicular display rack 1 extends outwardly perpendicularly from the vertical support rack 40 so as to utilize otherwise unoccupied space between the items which would be on the peg board. Also, secondary frame 4 has a book 70 located in its front side and a package 68 located in its back, as shown.

Figure 3:
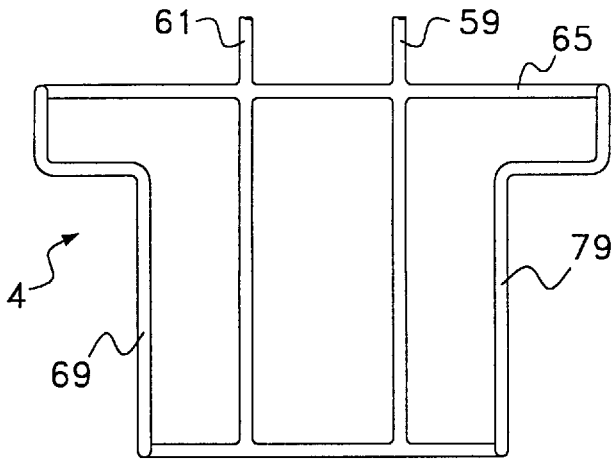
FIG. 3 shows a front view.
Figure 4:
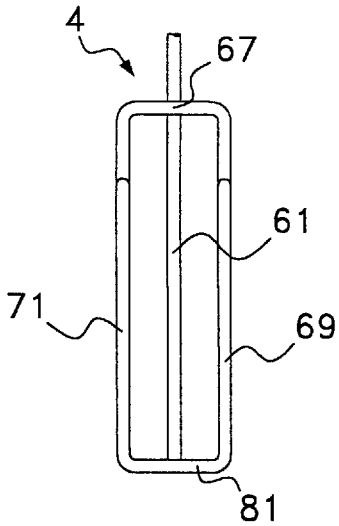
FIG. 4 shows a side view of the secondary frame of the present invention rack shown in FIGS. 1 and 2.

FIG. 3 and FIG. 4 show details of front and side views of secondary rack 4 from FIGS. 1 and 2 with identical parts identically numbered.

Figure 5:
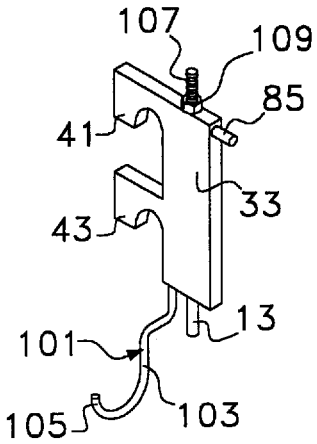
FIG. 5 shows a partial front perspective view of an attachment member of a present invention rack as shown above and illustrates a j-hook type securing means for inhibiting easy removal or accidental removal of a present invention rack from a support.

FIG. 5 shows a blow up partial section of insertable section 33 and its connecting rods from FIG. 1, with identical parts identically numbered. Orifice 53 shown in FIG. 1 contains in FIG. 5 a j-hook 101 with top end 107 being threaded to receive nut 109 and has a bottom portion 103 with j-hook 105.

Referring now to both FIGS. 2 and 5, it can be seen that j-hook 101 could be inserted into slot 66 of vertical support 40 and then bolted to secure present invention rack 1 to prevent easy removal.

Figure 6:
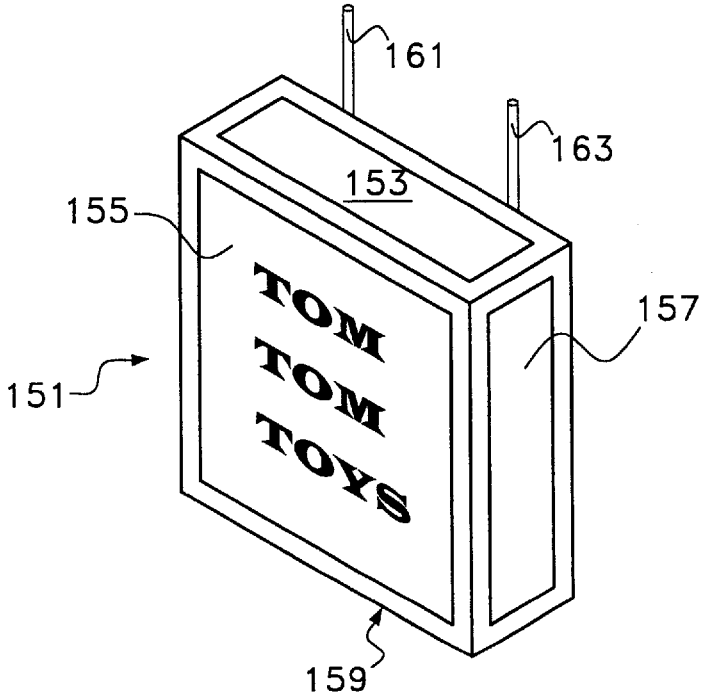
FIG. 6 shows an alternative embodiment secondary frame which may be used as a component of a present invention rack.

FIG. 6 shows one example of an alternative embodiment secondary frame 151 to replace secondary frame 4 shown in FIGS. 1 and 2 above. Here, secondary frame 151 has side walls such as front 155 and aisle side 157 with a closed bottom 159 and an open top 153 to receive and hold packages. It includes connecting rod sections 161 and 163 which would connect to rod 57 of FIGS. 1 and 2. The sides could have removable panels for advertising.

Figure 7:
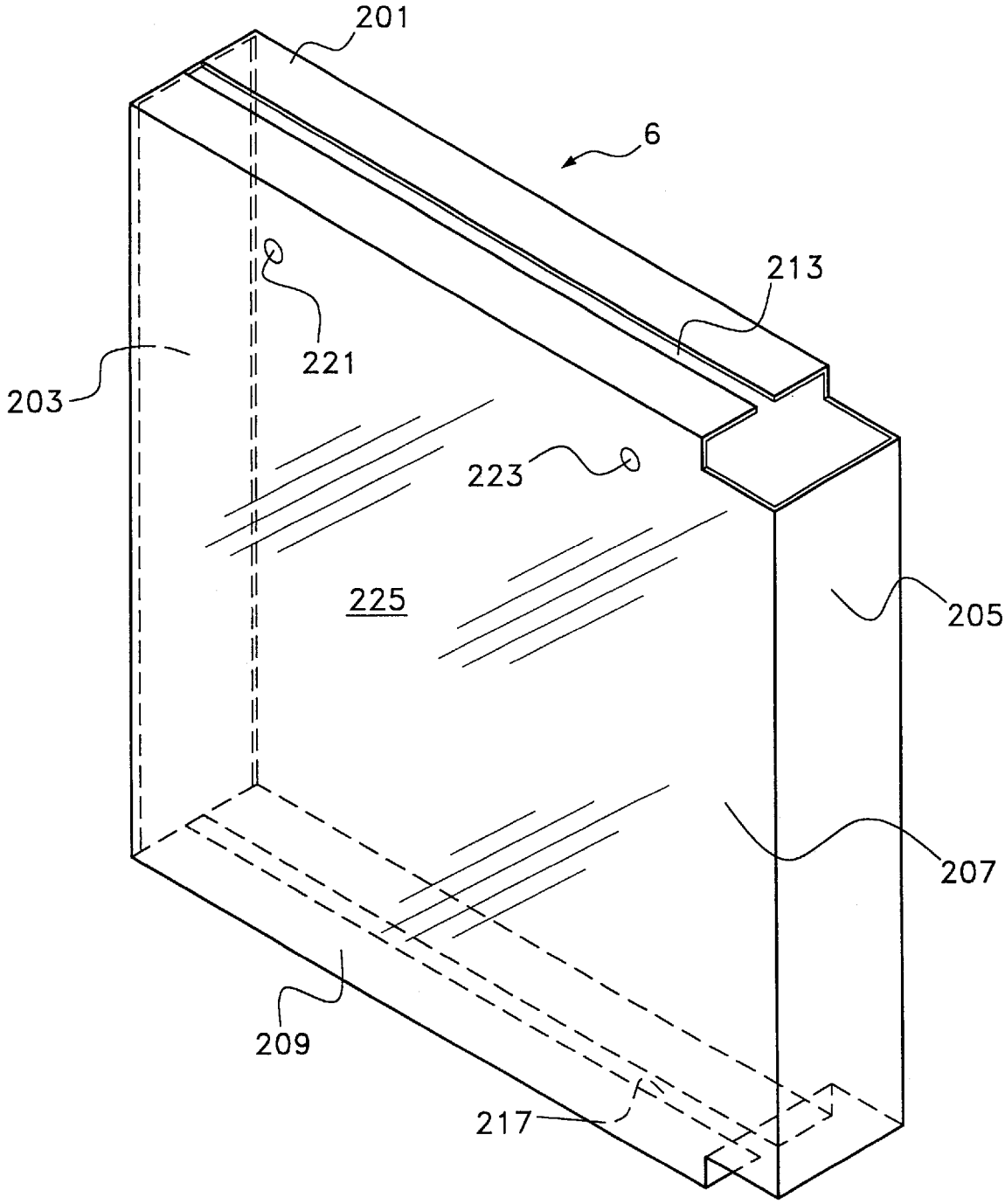
FIG. 7 illustrates a main frame protective cover which slidably mounts the main frame of the present invention device shown in FIGS. 1 and 2.

FIG. 7 shows a clear plastic slip cover 6 which attaches to main frame 2 shown in FIGS. 1 and 2. Cover 6 has a front 207, an aisle side 205, a top 201, a bottom 209, a back 225 and an open attachment side 203. Referring to both FIGS. 2 and 7, it can be seen that cover 6 may slip over main frame 2 and could be bolted or screwed to optional washers 91, 93, 95 and 97. Also, the open slots 213 and 217 permit slippage over rods 59 and 61. Attachment orifices 221 and 223 as well as corresponding back side orifices (not shown). Other types of covers such as glass or other materials having at least one side transparent could be used in place of cover 6 without exceeding the scope of the present invention.

Obviously, numerous modifications and variations of the present invention are possible in light of the above teachings. It is therefore understood that within the scope of the appended claims, the invention may be practiced otherwise than as specifically described herein.

What is claimed is:

1. A perpendicular display rack for attachment to a vertical support of a display rack system, said vertical support having a plurality of vertical slots thereon, said perpendicular display rack comprising:

(a) a main frame having portions connected to one another to form a first device capable of holding a package within said main frame, said main frame having an open top and being formed of four connected wire sections at said top, and at least two vertical wires extending downwardly from said top, and at least one horizontal wire connecting said two vertical wires to form a bottom, thus creating and encompassing open space in x-plane, y-plane and z-plane, and having an open inserting area, said opening inserting area having sufficient opening to insert a package therein, one of said main frame vertical wires being an attachment side;

(b) a vertical attachment component connected to said attachment side of said main frame and having at least two insertable hold tabs, each being adapted for alignment with and insertion into vertical slots of a vertical support;

(c) a secondary frame extending downwardly from said main frame, and having portions connected to one another to form a second device capable of holding another package within said secondary frame, said secondary frame having an open top, sides and a bottom being established by connected wire, and thus creating and encompassing space in x-plane, y-plane and z-plane, and having open inserting area having sufficient opening to insert a package therein; and, (d) a securing component for securing at least one vertical attachment component to a vertical support, which includes a combination of at least one orifice located on said vertical attachment component and a fastening device adapted to pass through said orifice and securely attach said rack to at least one vertical slot of a vertical support.

2. The perpendicular display rack of claim 1 which further includes:

(e) a removable cover, attachable to said main frame, said cover being slidably attachable and removable, and having at least four sides, at least one of which is transparent.

3. The perpendicular display rack of claim 2 wherein at least one of said removable cover and said main frame include cover securing means to inhibit removal of said cover from said main frame, said covering securing means being fastening means for nut and bolt attachment of said cover to said frame.

4. The perpendicular display rack of claim 1 wherein said main frame first device is formed of open frame hollow tubular wire material.

5. The perpendicular display rack of claim 4 wherein said main frame first is a metal device.

6. The perpendicular display rack of claim 4 wherein said main frame first device is a plastic device.

7. The perpendicular display rack of claim 1 wherein said main frame first device is formed of open frame solid wire material.

8. The perpendicular display rack of claim 7 wherein said main frame first device is a metal device.

9. The perpendicular display rack of claim 7 wherein said main frame first device is a plastic device.

10. The perpendicular display rack of claim 1 wherein said main frame forms a six sided rectilinear first device having a top, bottom, front, back, an aisle side and an attachment side, and said open inserting area is selected from said top, said front, said back and said aisle side.

11. The perpendicular display rack of claim 1 wherein said fastening device is a threaded j-hook and nut, and wherein the hooked end of said j-hook is attachable to a slot of a vertical support to a display rack system, and an end opposite said hooked end of said j-hook is adapted to pass through said at least one orifice of said vertical attachment component;

wherein when said nut is attached to said threaded j-hook, it secures said j-hook to said vertical attachment component and to a vertical support of a display rack system.

12. The perpendicular display rack of claim 1 wherein said main frame has an overall dimension in an x-plane, being a first horizontal plane, and an overall dimension in a y-plane, being a second horizontal plane, and an overall dimension in a z-plane, being a vertical plane, wherein said first horizontal plane overall dimension and said vertical plane overall dimension are each at least three times greater than said second horizontal plane overall dimension.

* * * * *